United States Patent [19]

Deffner et al.

[11] Patent Number: 4,615,443

[45] Date of Patent: Oct. 7, 1986

[54] BEVERAGE BOTTLE PACKAGE DISPLAY SYSTEM

[75] Inventors: John F. Deffner, Lisle; Raymond R. Young, Glenview; Russell M. Barnes, Bloomingdale, all of Ill.

[73] Assignee: Visual Marketing Inc., Chicago, Ill.

[21] Appl. No.: 688,291

[22] Filed: Jan. 2, 1985

[51] Int. Cl.[4] ..... B65D 85/20; B65D 21/02

[52] U.S. Cl. ..... 206/427; 206/449; 206/503; 206/511

[58] Field of Search ..... 206/427, 503, 511, 428, 206/432, 433, 509, 449; 220/23.6, 23.8

[56] References Cited

U.S. PATENT DOCUMENTS

| | | | |
|---|---|---|---|
| 3,752,310 | 8/1973 | Higgin | 206/427 |
| 3,949,876 | 4/1976 | Bridges et al. | 206/503 |
| 4,032,007 | 6/1977 | Graser et al. | 206/427 |
| 4,036,391 | 7/1977 | Prodel | 206/427 |
| 4,213,529 | 7/1980 | Whitaker | 206/503 |
| 4,269,309 | 5/1981 | Prodel | 206/427 |

OTHER PUBLICATIONS

Permastak TM display system.

*Primary Examiner*—Joseph Man-Fu Moy
*Attorney, Agent, or Firm*—Willian Brinks Olds Hofer Gilson & Lione

[57] ABSTRACT

A beverage bottle package display system is disclosed. The display system includes a base unit, a plurality of shelves and a shelf holder. The base unit and each shelf have a horizontally extending rib and two vertically extending ribs on their top sides. Each horizontal rib intersects two vertical ribs to form six rectangular compartments on the top side of the base unit and each shelf. Each compartment is define to accept one package of twelve 12-ounce beverage bottles or two packages of six 12-ounce beverage bottles. The display is built by placing any combination of 12-bottle packages or two 6-bottle packages in the base unit compartments. A first shelf is then placed on top of the packages in the base unit, and the first shelf compartments are filled with 12-bottle and/or two 6-bottle packages. Successive shelves of 12-bottle or 6-bottle packages may be added to the display system in the same manner. The ribs on the top sides of the base unit and shelves, along with skirts provided around the perimeters of the base unit and shelves, restrain the packages within the compartments from shifting. Ridges are also provided on the underside of each shelf to provide an additional restraint against the tops of the packages in the base unit or shelf compartments immediately below. The shelf holder is provided to store empty trays as the packages are removed from the display. A plurality of corrugation grooves in the floor of the shelf holder maintain the empty trays in a vertically upright position so they do not fall over.

12 Claims, 9 Drawing Figures

BEVERAGE BOTTLE PACKAGE DISPLAY SYSTEM

BACKGROUND OF THE INVENTION

This invention relates to a display system for beverage bottle packages and, in particular, to a display system for 12-bottle and 6-bottle packages.

Retail merchandisers have found that large floor displays of beverage packages are a good way to market popular beverages, such as soda and beer. For special promotions a large floor display of beverage packages is particularly desirable when there is a shortage of shelf space. And even when limited shelf space is available, a floor display may be more advantageous for a special promotion because limited shelf space requires labor to replenish the stock. A neat, attractive display is also helpful to generate sales by appealing to a person's impulses to purchase the displayed product.

The most popular beverage packages for floor displays are probably can packages. There are at least two good reasons for this popularity. First, the configurations of the common 24-can packages and 12-can packages are well-suited to serve as building blocks for sturdy, self-supporting displays. Thus, these displays are easy to build. Second, many beverage producers invest a lot of money to design a colorful, attractive 24-can and 12-can packages, which makes for an aesthetically pleasing display.

The ubiquitous 6-can packages are also amenable to a floor display if they are stacked in the case containers in which are usually delivered to a retailer. If they are stacked in a display without their case containers, the 6-can packages become unstable as the display grows in height. Thus, the case containers, which hold four 6-can packages, are necessary to provide stability to a large display. Moreover, these case containers generally only cover the bottom halves of the cans, which allows easy removal of the 6-can packages from the display and reveals the top-halves of the cans, which are usually colorful and attractive.

From a marketing point of view, large floor displays of beverage bottle packages are probably just as desirable to a retailer as floor displays of beverage can packages. In fact, the need for large floor displays of beverage bottle packages is increased by the fact that many people prefer their beverages from a bottle rather than a can. Building a large floor display of beverage bottle packages, however, is not a straightforward matter.

One significant problem is stability. For example, beer, a popular bottled beverage, is typically sold in six 12-ounce bottle or twelve 12-ounce bottle packages. The shape and rigidity of these packages allow a small, stable display (a couple rows high) to be built, but larger displays usually become increasingly unstable as more rows are added. A stable display is critical for glass bottle packages, especially since the display is vulnerable to being bumped by customers or their shopping carts.

One approach to building a floor display for beverage bottle packages is to leave the 6-bottle or 12-bottle packages in their case containers. These packages usually come in a 24-bottle cardboard case container that encloses the smaller packages. If necessary, the tops of each case container are cut off before the display is built to allow the smaller packages to be easily removed by the customers.

While this approach overcomes the stability problem, it is not entirely satisfactory. For some beverages, such as beer, the case containers completely enclose the bottle packages. Thus, even if the top of the case container is removed, the sides of the relatively unattractive case container conceal all or most of the colorful bottle packages. The result is a display that is less appealing than one that highlights the attractive bottle packages. Moreover, when a case container has been emptied by customers, it requires attention and labor to be removed from the display. Otherwise it adds clutter and detracts from the display's appearance.

A company called "Paul Flum ideas inc." of St. Louis, Missouri has taken another approach, the PERMASTAK TM display system, for one particular type of 6-bottle package. The distinguishing feature of this particular package is that the necks of all six bottles extend through and above the top of the package. To this end, the PERMASTAK TM display system includes a base unit, a plurality of shelves and a shelf holder. The top sides of the base unit and each shelf are divided into 12 rectangular compartments by two vertical and three horizontal intersecting ribs. Each compartment is designed to accept one of the 6-bottle packages. Shelves are stacked on successive rows of packages to build the display. The ribs, along with a raised skirt around the perimeter of the base unit and each shelf, provide abutments for the bottoms of the 6-bottle packages. Six circular troughs are formed into the top side of each shelf compartment to provide corresponding circular ridges on the undersides of the shelves. A shelf is placed on top of a row of these particular packages so that the tops of the bottles will be enclosed by the circular ridges. The shelf holder is provided to store empty shelves.

While the PERMASTAK TM system provides certain advantages in building a floor display for one particular type of bottle package, it still leaves a number of important problems unsolved. For instance, a separate system is required for other types of packages, such as 12-bottle packages. Moreover, if this system is to be used for enclosed bottle packages (such as most beer bottle packages), the circular ridges will provide no additional stability. In fact, these ridges may actually decrease the stability of the system because they reduce the surface area on which the shelf sits. Still another shortcoming of the PERMASTAK TM display system is that its shelf holder has a smooth bottom. Thus, the empty trays placed within the shelf holder must lean against an adjacent wall or the display, or they will fall over. If the empty trays lean against the display, they make it more difficult to remove packages from the display and may still fall over when the display gets too low. If a wall is required to support the empty shelves, the locations in which the PERMASTAK TM system can be used are limited.

SUMMARY OF THE INVENTION

The present invention is directed to a new type of display system for beverage bottle packages.

According to the invention, the display system includes a base unit, at least one shelf, and a shelf holder. The base unit and each shelf have a horizontally extending rib and at least one vertical rib on their top sides. These ribs cooperate to form a plurality of compartments, each of which is defined to accept one 12-bottle package or two 6-bottle packages. The shelf holder has a rib that locks into a channel in the base unit and a storage compartment for holding empty shelves. A plurality of corrugation grooves are provided in the floor of the storage department to accept lips provided on skirts on the shelves.

In the preferred embodiment of the invention, one horizontal rib and two vertial ribs intersect on the top sides of the base unit and each shelf to form six rectangular compartments thereon. Each shelf compartment has linear troughs at its upper and lower boundaries that provide corresponding ridges on the underside of the shelf. Both the base unit and each shelf have skirts around their perimeters that extend above and below their top sides.

When used to build a floor display of beverage bottle packages, the present invention overcomes many of the disadvantages of prior approaches. Either one 12-bottle or two 6-bottle packages can be placed in any base or shelf compartment. Thus, only one display system is needed for two of the most popular beverage bottle packages used by retailers. The ribs and skirts provide a stabilizing restraint for the packages in the system. The shelf troughs (or the corresponding ridges) provide additional restraint on either type of package on a lower level. The corrugation grooves in the shelf holder keep empty shelves in the storage compartment without the need for leaning the empty shelves against the display or an adjacent wall. Thus, the present invention is well suited for use as a free-standing display in the center of a floor. All these features of the present invention cooperate to provide an attractive, stable floor display that can be used with a wide variety of beverage bottle packages.

The invention itself, together with further objects and attendant advantages, will best be understood by reference to the following detailed description taken in conjunction with the drawings.

DETAILED DESCRIPTION OF A PREFERRED EMBODIMENT

Figure 1:
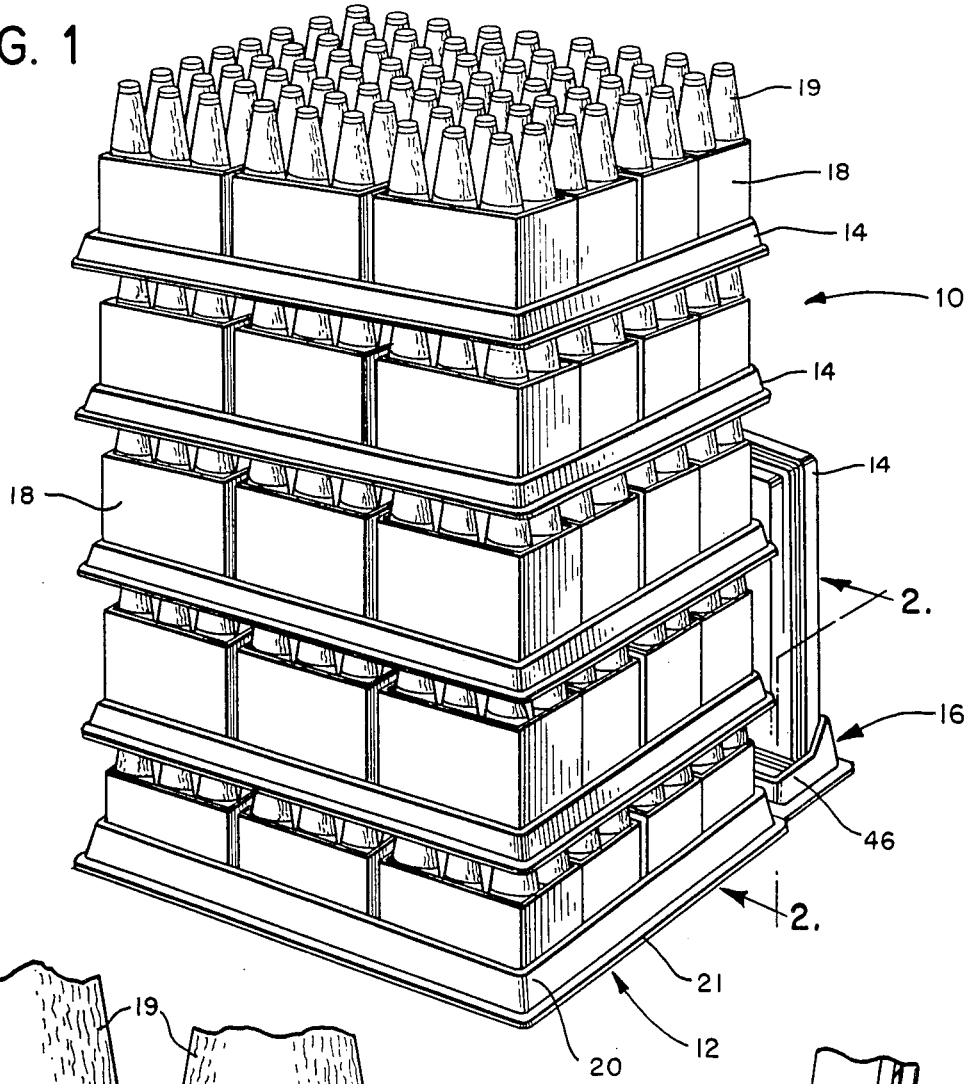
FIG. 1 is a perspective view of a beverage bottle package display system in a preferred embodiment of the present invention.

Referring now to the drawings, FIG. 1 shows a beverage bottle package display system 10. The three basic components of the display system are a base unit 12, a plurality of interlocking shelves 14 and a shelf holder 16. The base unit and shelves are designed to hold a plurality of beverage bottle packages 18.

The bottle packages 18 shown in FIG. 1 are intended to hold six conventional 12-ounce beer bottles 19. These packages will be referred to as 6-bottle packages. The preferred embodiment of the invention described herein is also intended to display packages containing twelve conventional 12-ounce beer bottles, which will be referred to as 12-bottle packages. It is intended that general references to packages 18 herein encompasses both 6-bottle and 12-bottle packages.

Those familiar with the various brands of beer currently sold in the United States are aware that 12-ounce beer bottles come in a variety of shapes. For example, some are tall and narrow while others are shorter and wider. The preferred embodiment described herein is designed to display all common forms of conventional 12-ounce beer bottles without modification of the display system 10 components.

Those familiar with the various brands of beer presently popular in the U.S. are also aware that there are a number of different types of 6-bottle and 12-bottle packages. The 6-bottle packages shown in FIG. 1 do not cover the tops of the bottles 19. It is more common, however, for both 6-bottle and 12-bottle packages to completely enclose the beer bottles herein. The preferred embodiment disclosed herein is also designed to display all the various forms of 6-bottle and 12-bottle packages without modification of the display system 10 components.

Figure 2:
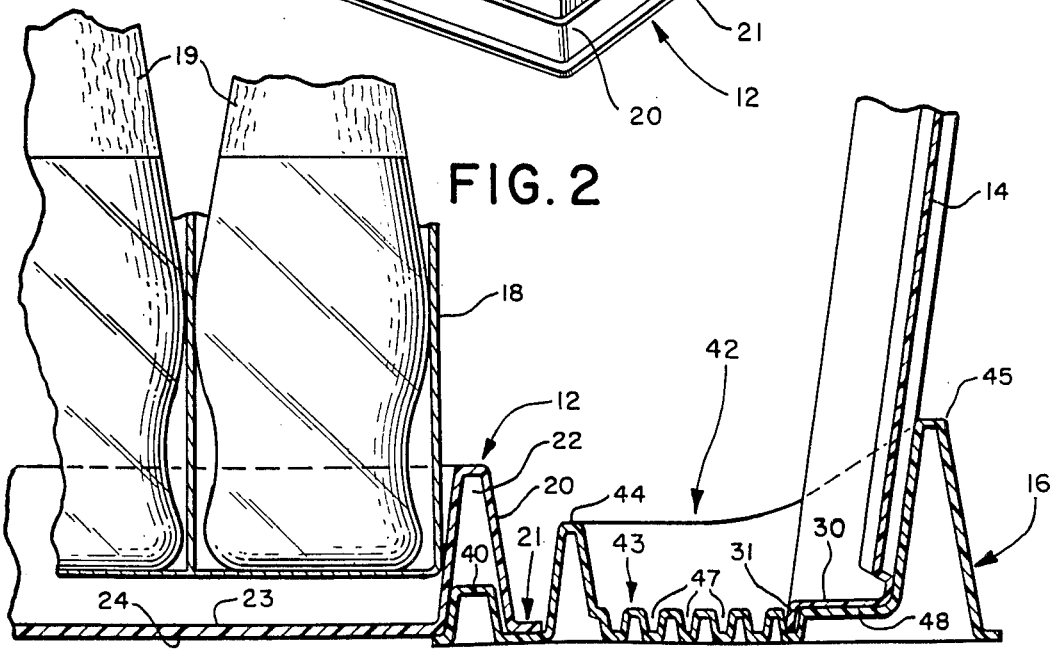
FIG. 2 is sectional view taken along lines 2—2 of FIG. 1.
Figure 3:
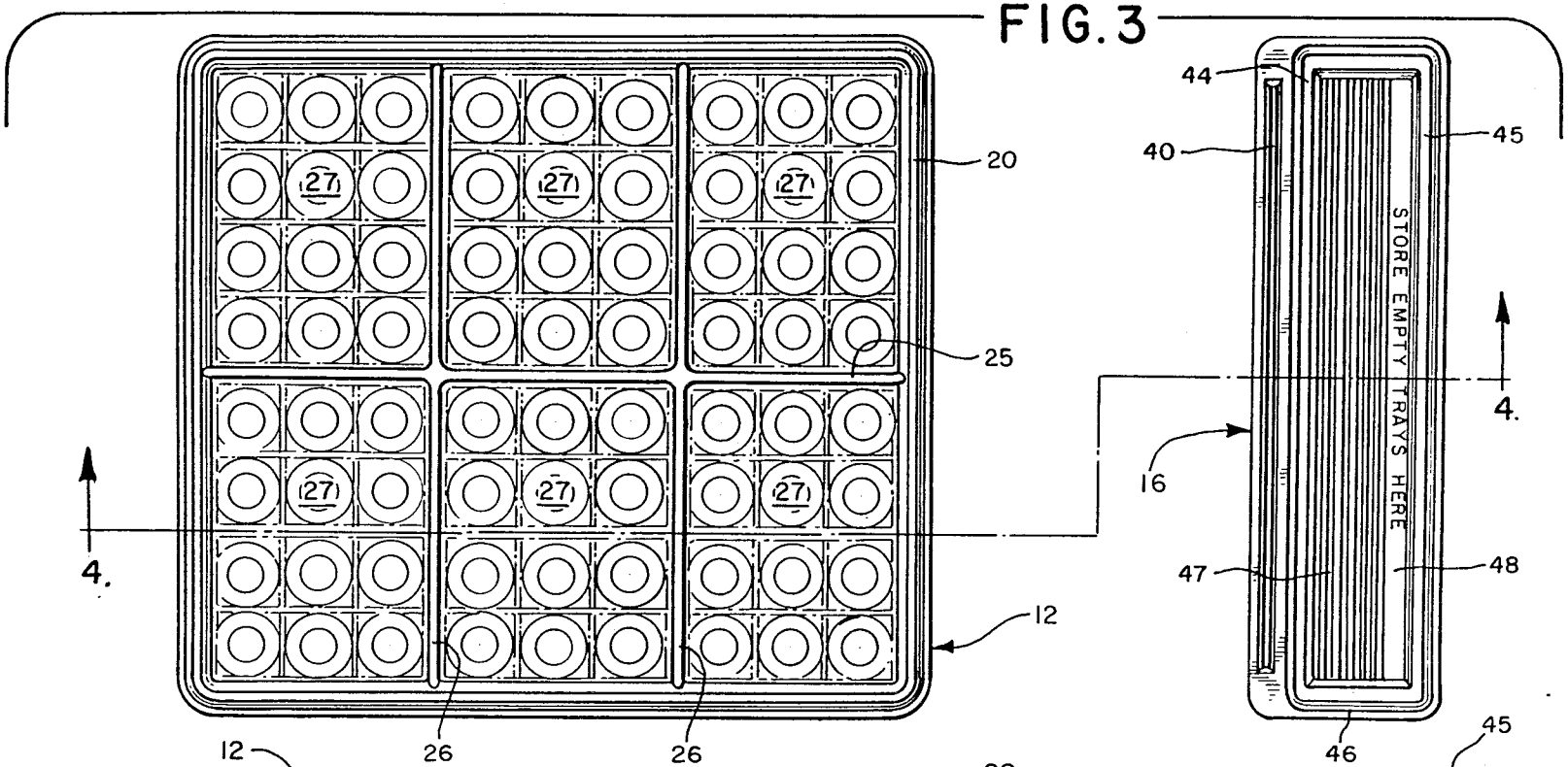
FIG. 3 is a top plan view of a base unit and shelf holder in a preferred embodiment of the present invention.
Figure 4:
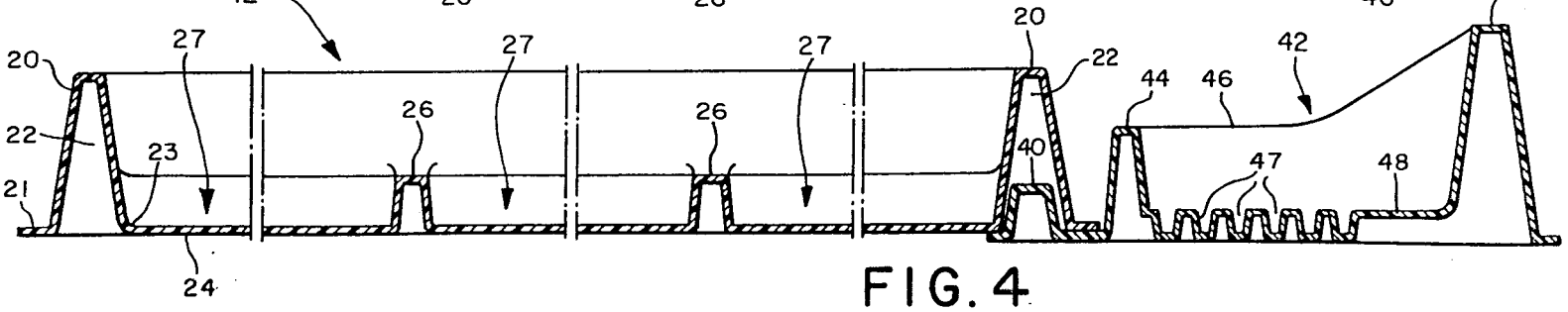
FIG. 4 is a sectional view taken along lines 4—4 of FIG. 3.
Figure 5:
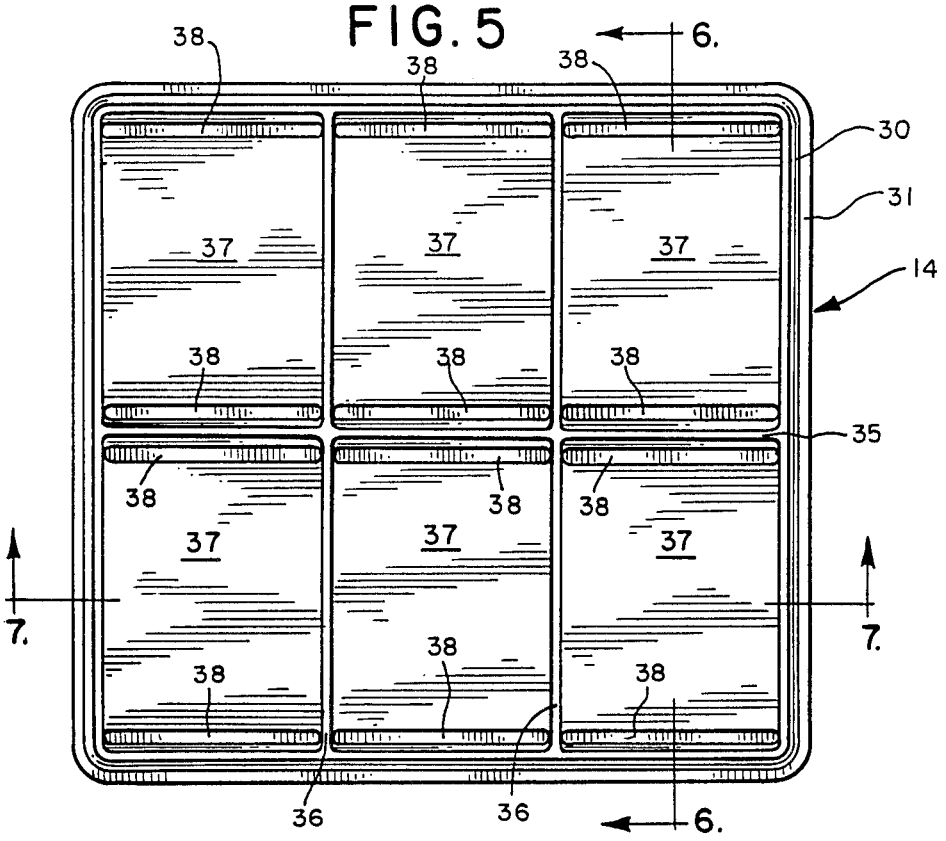
FIG. 5 is top plan view of a shelf in a preferred embodiment of the present invention.
Figure 6:
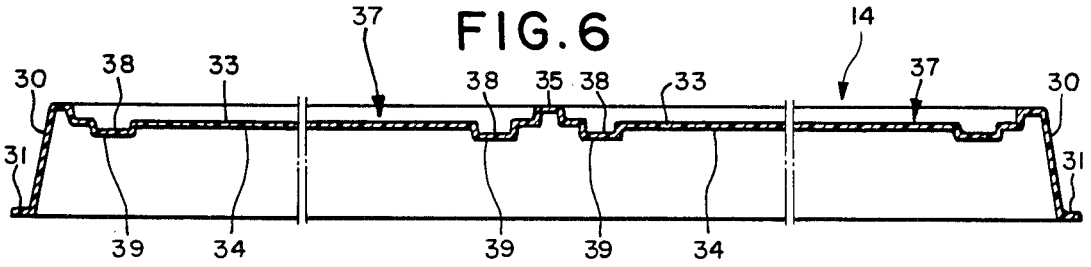
FIG. 6 is a sectional view taken along lines 6—6 of FIG. 5.
Figure 7:
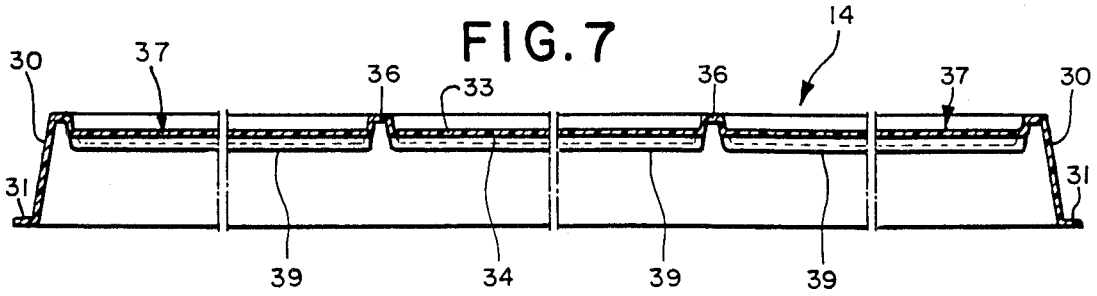
FIG. 7 is a sectional view taken along lines 7—7 of FIG. 5.

Referring now to FIGS. 2–4, the base unit 12 has an inverted V-shape skirt 20 around its rectangular perimeter. The skirt 20 rises above the top side 23 of the base unit 12 so that it forms a channel 22 around the underside 24 of the base unit. The outermost edge of the skirt 20 is provided with a lip 21 to distribute the weight of the packages 18 in the base unit 12. One horizontally disposed rib 25 and two vertically disposed ribs 26 are molded in the top side 23 of the base unit 12. These ribs extend across the top side 23 of the base unit to form six rectangular compartments 27 thereon. The base compartments 27 are defined by the ribs 25 and 26 and the inside of the skirt 20 to accept one 12-bottle package or two 6-bottle packages. It can be seen from FIG. 3 that the twelve bottles in each compartment 27 of the base unit 12 can be in either one 12-bottle package or two 6-bottle packages. The ribs 25 and 26 and the skirt 20 restrain the packages 18 in the top side 23 of the base unit 12 from shifting.

Figure 8:
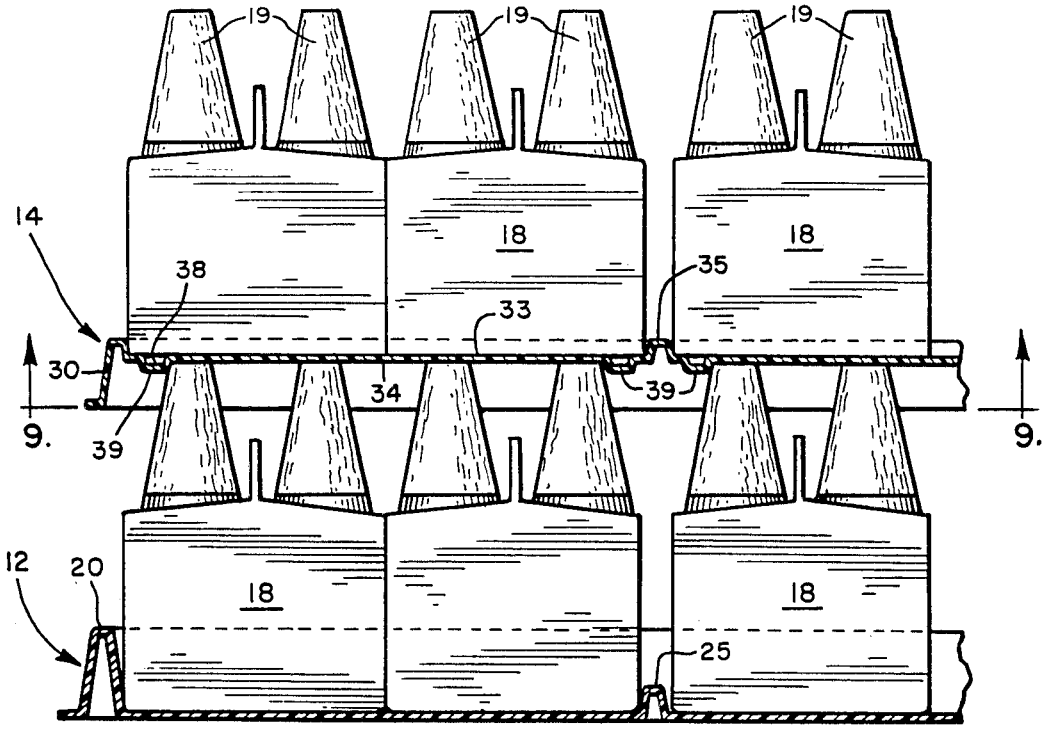
FIG. 8 is a partial side elevation view of a beverage bottle package display system in a preferred embodiment of the present invention.
Figure 9:
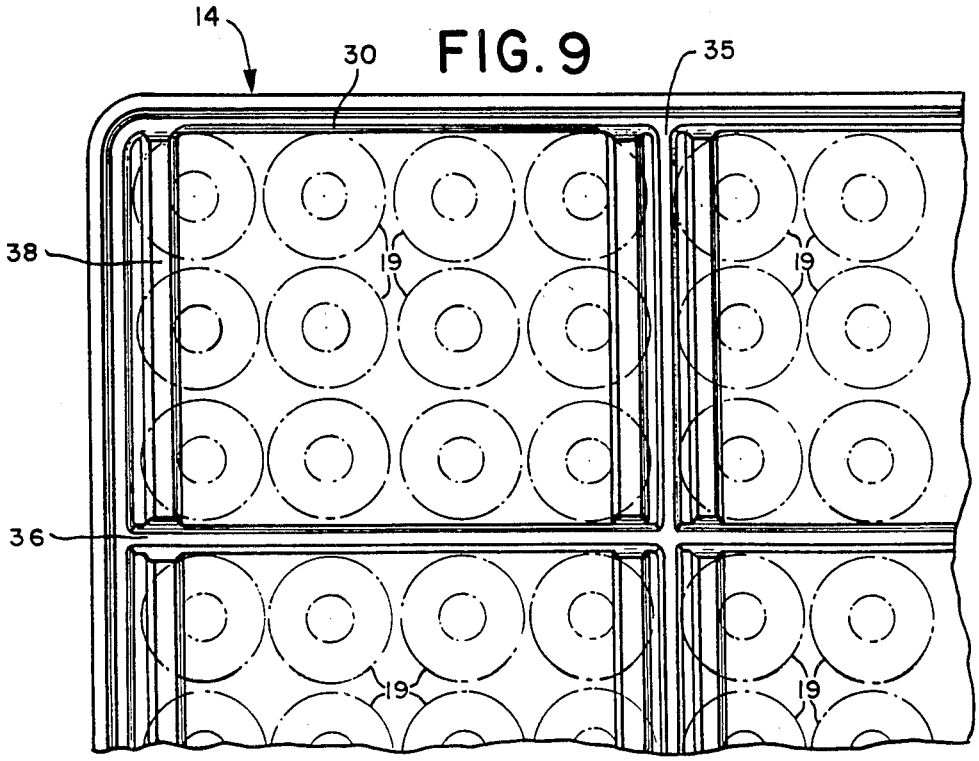
FIG. 9 is a sectional view taken along lines 9—9 of FIG. 8.

Each of the shelves (or trays) 14 is identical in structure and function. One of the shelves 14 will now be described with reference to FIGS. 5–9. The rectangular shaped shelf 14 has a skirt 30 around its perimeter. The skirt 30 rises above the top side 33 of the shelf 14 and then extends below the shelf's underside 34. A flat lip 31 is provided on the lowermost (or outermost) edge of the skirt 30. One horizontally disposed rib 35 and two vertically disposed ribs 36 are molded in the top side 33 of the shelf. These ribs extend across the top side 33 of the shelf 14 to form six rectangular compartments 37 thereon. Like the base compartments 27, the shelf compartments 37 are defined by the ribs 35 and 36 and the inside of skirt 30 to accommodate one 12-bottle package or two 6-bottle packages. FIGS. 8 and 9 show that each shelf compartment 37 can hold twelve beer bottles 19 in either two 6-bottle packages or one 12-bottle package. The shelf ribs 35 and 36 and the shelf skirt 30 restrain the packages 18 on the top side 33 of a shelf from shifting.

Each shelf compartment 37 is also provided with two linear troughs 38 on the top side 33 of the shelf 14. One trough 38 extends horizontally across the upper boundary of a shelf compartment 37, and another trough 38 extends horizontally across the lower boundary of the same compartment. Each trough 38 provides a corresponding ridge 39 on the underside 34 of the shelf. When a shelf 14 is placed on a row of packages 18 in a lower shelf or base unit 12, the ridges 39, along with the part of the skirt 30 extending below the underside 34 of the shelf, will further restrain the packages in the lower shelf or base unit from shifting. The restraint provided by the ridges 39 is illustrated in FIGS. 8 and 9.

The shelf holder 16 is provided to store empty shelves 14. As shown in FIGS. 1–4, the shelf holder 16 has a horizontally extending rib 40 that locks into the base channel 22, thereby connecting the shelf holder 16 to the base unit 12. The shelf holder 16 also has a storage compartment 42 for holding empty shelves 14. The storage compartment 42 is defined by a floor 43, a front wall 44, a back wall 45 and two side walls 46. The floor 43 has a plurality of corrugation grooves 47 and a flat surface 48. Each corrugation groove 47 should be as deep as the lip 31 on any shelf 14 in the display system. Preferably, there is as many corrugation grooves 47 as there are shelves 14 in the display system. The flat surface 48 should be long as the height of the skirt 30 on any shelf 14.

In the presently preferred embodiment of the invention, the base unit 12, the shelves 14 and the shelf holder 16 are all made of white, high-impact, utility grade polystyrene with rubber modifiers. This material is thicker, stronger and less brittle than the pure polystyrene currently used in the PERMASTAK TM system. Decals of particular beverage manufacturers' logos can be placed on the outside surfaces of the base skirt 20, the tray skirts 30 or the shelf holder 16. Alternatively, the base unit 12, shelves 14 or shelf holder 16 can be made of a virgin polystyrene grade material which is amenable to decoration (e.g. manufacturer's logos) during manufacture of these components.

In the presently preferred embodiment of this invention all the base compartments 27 and shelf compartments 37 have identical dimensions. Each compartment is approximately $8\frac{3}{8}$ inches by $11\frac{1}{2}$ inches. It is found that this size compartment adequately accommodates 6-bottle and 12-bottle packages for a number of differently shaped 12-ounce beer bottles. Of course, the diameters of these various types of 12-ounce beer bottles are nearly the same. The ribs on the base unit 12 and shelves 14 are about $\frac{1}{4}$ inch wide, and the troughs 38 on the top sides of the shelves are also about $\frac{1}{4}$ inch deep. The base ribs 25 and 26 are about $\frac{1}{2}$ inch high. The shelf ribs 35 and 36 are about $\frac{1}{4}$ inch high.

Since their compartment sizes are identical, the areas of the shelf top sides 33 and the base unit top side 23 are also identical. The base skirt 20 is slightly larger than the shelf skirts 30 in the presently preferred embodiment.

In the shelf holder 16 of the presently preferred embodiment, the shelf holder rib 40 is short enough to lock into the base channel 22 on any side of the base unit 12. The width of the shelf holder rib 40 should be close to that of the base channel 22. The corrugation grooves 47 in the storage compartment 42 are about $\frac{1}{4}$ inch deep, which corresponds to the width of the shelf lips 31. The flat surface 48 of the floor 43 is $1\frac{1}{4}$ inches long, which corresponds to the height of the shelf skirts 30. The back wall 46 of the storage compartment 42 is around 25/16 inches tall, and the front wall 45 is about $1\frac{1}{2}$ inches high. The side walls 46 are spaced apart so that empty shelves 14 must be placed in the storage compartment with their horizontal ribs 35 pointing vertically upward.

A beverage bottle package display system 10 in accordance with the present invention can be assembled as follows. The base unit 12 is set on a floor in its desired location. The shelf holder 16 is connected to the base unit 12 by inserting the shelf holder rib 40 into the base channel 22. One 12-bottle package 18 or two 6-bottle packages 18 are placed into each compartment 27 of the base unit. There is nothing to prevent combinations of 6-bottle and 12-bottle packages of the same, or different, brands of beer from being placed within the various base compartments 27. It is important, however, that all the packages 18 in the base compartments 27 are the same height if additional rows of beer packages are to be stacked on the base unit.

A first shelf 14 is then carefully placed over the tops of the packages 18 in the base unit 12. The shelf should be slid slightly until it seats itself; that is, the ridges 39 and the skirt 30 on the underside 34 of the shelf 14 fit snugly against the tops of the bottle packages 18 in the base unit 12. Since the outer dimensions of the shelves 14 and the base unit 12 are the same, the first shelf and the base unit 12 should be vertically aligned. This insures proper fit of the shelf and good stability of the display.

Any combination of 6-bottle and/or 12-bottle packages 18 can be loaded into the first shelf compartments 37, although all the packages should be the same height for the reason mentioned above. Additional shelves 14 can be stacked on successive rows of beer packages 18 in the same manner described in the preceding paragraph. Care should be taken to see that all the shelves 14 are vertically aligned with each other and the base unit 12. It is contemplated that most displays built in accordance with the present invention will use six or less shelves 14. This is because most retailers want these type of displays to be no more than 54 inches high.

As consumer purchases empty the shelves 14 of packages 18, the empty shelves should be stored vertically in the shelf holder 16 as shown in FIGS. 1 and 2. The empty shelves 14 are stored in the storage compartment 42 of the shelf holder 16 by placing the lip 31 of the empty shelf in a corrugation groove 47 as shown in FIG. 2. The lip 31 of the first empty shelf 14 should be inserted in the corrugation groove adjacent to the flat surface 48 so that the skirt 30 of the shelf rests on the flat surface 48. The lips 31 of successive empty shelves should be placed in adjacent corrugation grooves so that the skirts.30 of these shelves will rest inside the skirt 30 of the shelf immediately in front of it in the storage compartment 42. The height of the back wall 45 of the storage compartment 42 is designed to cooperate with the corrugation grooves 47 to maintain the empty shelves 14 within the storage compartment 42 in a vertically, upright position without the assistance of an external, stationary object, such as an adjacent wall. In other words, the back wall 45 of the storage compartment 42 and the corrugation grooves 47 prevent the empty trays from falling over when they are stored in the shelf holder 16.

It will be apparent from the foregoing description that a beverage bottle package display system embodying the present invention provides important advantages over prior approaches. Only one beverage bottle package display system is needed for 6-bottle packages, 12-bottle packages, or a combination of the two. Moreover, the same display system can be used for a variety of different types of 6-bottle and 12-bottle packages, for example, open-top packages, closed top packages, packages with tall, narrow bottles or packages with shorter, wider bottles. The white plastic components of the preferred embodiment, when combined with the colorful packaging of most bottled beer packages, create an attractive beverage bottle package display system. The corrugation grooves 47 in the storage compartment 42 of the empty shelf holder 16 enable a display system of the present invention to be used as a free-standing display in the center of a floor. This makes stability vital because such a display is more prone to being bumped by shoppers or their carts. The unique rib design on the base unit 12 and interlocking shelves 14 and the ridge design on the undersides of the shelves 14 of the present invention allow a versatile, stable, and visually attractive beverage bottle package display system to be built.

It should be understood that various changes and modifications to the preferred embodiment described above will be apparent to those skilled in the art. For example, the presently preferred embodiment has been designed for 6-bottle and 12-bottle packages of 12-ounce beer bottles. The invention can also be adapted to accommodate other size bottles (e.g. 16 ounce) and different size packages, such as 8-bottle and 4-bottle. The number of base compartments 27 and shelf compartments 37 can be varied by changing the overall dimensions of the base unit 12 and shelves 14 and by adding or subtracting vertical and horizontal ribs thereto. It is also not necessary for the base unit ribs 25 and 26 and the shelf ribs 35 and 36 to extend completely across the top sides of their respective components. They only have to extend far enough along the top sides of the base unit and shelves to define the compartments and provide adequate restraint against packages in the compartments shifting.

It is intended that the foregoing description be regarded as illustrative rather than limiting, and that it be understood that it is the following claims, including all equivalents, which are intended to define the scope of this invention.

We claim:

1. A display system for beverage bottle packages comprising:

a base unit having a skirt along its perimeter that forms a base channel on the underside of the unit, a horizontally extending rib on the top side of the unit, and at least one vertically extending rib on the top side of the unit that cooperates with the horizontal base rib to form a plurality of compartments, each compartment defined to accept one 12-bottle package or two 6-bottle packages;

at least one shelf, each shelf having a skirt along its perimeter and the skirt having a lip along its lower edge, a horizontally extending rib on the top side of the shelf, and at least one vertically extending rib on the top side of the shelf that cooperates with the horizontal shelf rib to form a plurality of compartments, each compartment defined to accept one 12-bottle package or two 6-bottle packages; and a shelf holder having a rib that fits into the base channel and a compartment for storing shelves, the floor of the storing compartment having a plurality of corrugation grooves for accepting the lips on the shelves.

2. The invention of claim 1 wherein the base unit includes two vertically extending ribs that cooperate with the horizontal base rib to form six compartments.

3. The invention of claim 2 wherein each shelf includes two vertically extending ribs that cooperate with the horizontal shelf rib to form six compartments.

4. The invention of claim 1 wherein each shelf also includes a plurality of linear troughs, each trough extending along the edge of a shelf compartment and providing a corresponding ridge on the underside of the shelf.

5. A beverage bottle package display system comprising:

a base unit having a skirt around its perimeter that rises above the top side of the unit and forms a base channel on the underside of the unit, a horizontally extending rib on the top side of the unit, and at least one vertically extending rib on the top side of the unit that cooperates with the horizontal base rib to form a plurality of compartments, each compartment defined to accept one 12-bottle package or two 6-bottle packages;

a plurality of 12-bottle packages or two 6-bottle packages placed within the compartments of the base unit;

a first shelf having a skirt around its perimeter that extends above and below its top side and the skirt having a lip along its lower edge, a horizontally extending rib on the top side of the shelf, at least one vertically extending rib on the top side of the shelf that cooperates with the horizontal shelf rib to form a plurality of compartments, each compartment defined to accept one 12-bottle package or two 6-bottle packages, and a plurality of troughs, each trough extending along the edge of a compartment and providing a corresponding ridge on the underside of the shelf, the shelf being placed on the tops of the bottle packages in the base unit so that the shelf ridges and the shelf skirt provide a restraint for the tops of said bottle packages;

a plurality of 12-bottle packages or two 6-bottle packages placed within the shelf compartments; and a shelf holder having a rib that locks into the base channel and a compartment for storing shelves, the floor of the storing compartment having a plurality of corrugation grooves for accepting the lip of the shelf.

6. The invention of claim 5 wherein the base unit includes two vertically extending ribs that cooperate with the horizontal base rib to form six compartments.

7. The invention of claim 6 wherein the first shelf includes two vertically extending ribs that cooperate with the horizontal shelf rib to form six compartments.

8. The invention of claim 7 further comprising additional shelves structurally identical to the first shelf and a plurality of 12-bottle packages or two 6-bottle packages placed within the compartments of the additional shelves, each shelf being staked on the tops of the bottle packages in the shelf immediately below it so that its ridges provide a restraint for the tops of the packages immediately below it.

9. The invention of claim 8 having six shelves.

10. A display system for beverage bottle packages comprising:

a rectangular base unit having a skirt around its perimeter that rises above the top side of the unit and forms a base channel on the underside of the unit, a first base rib that extends horizontally across the top side of the unit, and second and third base ribs that extend vertically across the top side of the unit and intersect the horizontal base rib to form six rectangular compartments, each compartment defined to accept one 12-bottle package or two 6-bottle packages;

one or more rectangular shelves, each shelf having a skirt around its perimeter that extends above and below its top side and the skirt having a flat lip along its lower edge, a first shelf rib that extends horizontally across the top side of the shelf, second and third shelf ribs that extend vertically across the top side of the shelf and intersect the horizontal shelf rib to form six rectangular compartments, each compartment defined to accept one 12-bottle package or two 6-bottle packages, and a plurality of troughs that extend horizontally across the upper and lower edges of each compartment and provide corresponding ridges on the underside of the shelf; and a shelf holder having a horizontally extending rib that locks into the base channel on any side of the base unit, and a storage compartment defined by a floor, two side walls, a front wall and a back wall, the floor having a plurality of horizontally extending corrugation grooves and a flat surface, each corrugation groove being as deep as any shelf skirt lip and the flat surface being as long as the height of any shelf skirt.

11. The invention of claim 10 wherein each shelf compartment has a first trough horizontally extending across its upper boundary and a second trough horizontally extending across its lower boundary so that the corresponding ridges on the underside of the shelf will provide a restraint against the top of one 12-bottle package or the tops of two 6-bottle packages on the base unit or shelf below.

12. The invention of claim 10 wherein each shelf is identical in structure.

* * * * *